US007021458B2

(12) United States Patent
Cummings

(10) Patent No.: US 7,021,458 B2
(45) Date of Patent: Apr. 4, 2006

(54) SOAP BAR PACKAGE

(75) Inventor: Bruce Cummings, New York, NY (US)

(73) Assignee: Colgate-Palmollive Company, New York, NY (US)

( * ) Notice: Subject to any disclaimer, the term of this patent is extended or adjusted under 35 U.S.C. 154(b) by 77 days.

(21) Appl. No.: 10/251,744

(22) Filed: Sep. 20, 2002

(65) Prior Publication Data

US 2004/0055904 A1 Mar. 25, 2004

(51) Int. Cl.
*B65D 75/28* (2006.01)

(52) U.S. Cl. ..... 206/77.1; 206/462; 206/779; 229/162.1; 229/162.6

(58) Field of Classification Search ..... 206/77.1, 206/462, 463, 705, 779, 780; 229/87.05, 229/87.18, 87.19, 162, 162.1, 162.6
See application file for complete search history.

(56) References Cited

U.S. PATENT DOCUMENTS

| | | | | | |
|---|---|---|---|---|---|
| 1,448,435 | A | * | 3/1923 | Davis | 206/748 |
| 1,453,849 | A | * | 5/1923 | List | 206/45.22 |
| 1,725,372 | A | * | 8/1929 | Richman | 229/242 |
| 1,930,031 | A | * | 10/1933 | Andrews | 206/45.22 |
| 2,141,743 | A | * | 12/1938 | Ethridge | 206/750 |
| 2,177,999 | A | * | 10/1939 | Schwantes | 206/594 |
| 2,240,810 | A | * | 5/1941 | Snelling | 206/736 |
| 2,552,340 | A | * | 5/1951 | Moore | 229/87.05 |
| 3,065,848 | A | * | 11/1962 | Kuffik | 206/45.27 |
| 3,073,436 | A | * | 1/1963 | Burt | 229/203 |
| 3,159,274 | A | * | 12/1964 | Burt | 206/77.1 |
| 3,260,359 | A | * | 7/1966 | Willhite | 229/203 |
| 3,329,258 | A | | 7/1967 | Brown et al. | 206/45.14 |
| 3,352,409 | A | * | 11/1967 | Link | 206/763 |
| 3,554,367 | A | * | 1/1971 | Hoover | 206/463 |
| 4,146,128 | A | * | 3/1979 | Hogg et al. | 206/776 |
| 4,180,165 | A | * | 12/1979 | Kuchenbecker | 206/461 |
| 4,739,353 | A | * | 4/1988 | Heuer et al. | 206/316.2 |
| 6,336,553 | B1 | * | 1/2002 | Gordon | 206/77.1 |
| 6,394,337 | B1 | | 5/2002 | Ross et al. | 229/103.2 |

FOREIGN PATENT DOCUMENTS

| | | |
|---|---|---|
| CH | 536765 | 5/1973 |
| GB | 2279334 | 1/1995 |
| WO | WO9514623 | 1/1995 |
| WO | WO0117865 | 3/2001 |
| WO | WO02053467 | 7/2002 |

* cited by examiner

*Primary Examiner*—Mickey Yu
*Assistant Examiner*—Jerrold Johnson
(74) *Attorney, Agent, or Firm*—Harris A. Wolin

(57) ABSTRACT

The soap bar is contained in a package comprised of a first package and a second package. The first package fully surrounds and envelops the soap bar and in a preferred embodiment has a peripheral edge. The second package will contain one or more first packages with an aperture in at least one panel of the second package and a part of the first package protrudes through the second package and is stabilized in the second package. When the first package has a peripheral edge, it will be adjacent to the interior surface of the second package and additionally support the second package.

20 Claims, 4 Drawing Sheets

SOAP BAR PACKAGE

This invention relates to a soap bar package where a primary package supports a secondary package. This invention more particularly relates to a package where the primary package fully envelops the soap bar and provides the support for the secondary package that facilitates orientation on a display shelf.

BACKGROUND OF THE INVENTION

Soap bars are packaged in various ways. These include the use of paperboard cartons, plastic boxes, and paper and plastic wrapping. The objective is to protect the soap bar from contamination, maintain a given moisture content in the soap bar and to provide an acceptable appearance at the point of sale. In addition, the package also may provide for stability on the sales shelf so that the soap bars can be stacked several bars high and several bars deep on the shelf.

BRIEF SUMMARY OF THE INVENTION

The present soap bar package is comprised of a primary package and a secondary package. The soap bar can be of any shape. The primary package surrounds and encloses the soap bar. The secondary package holds and contains one or more of the primary packages and holds these primary packages in an orientation so that along with the secondary package they can be self supporting on a store display shelf and also can be stacked on the store shelf. In addition, they can move readily be fitted into a shipping carton.

The primary package in one embodiment is comprised of a relatively stiff, self supporting material. This primary package material encloses the soap bar and has an outwardly extending peripheral edge. The peripheral edge extends outwardly so as to contact the inner surface of the secondary package. It can be in essentially any orientation with respect to the soap bar. However, in one embodiment this edge can be an extension of a plane through the longitudinal axis of the soap bar at an angle of 0 degrees to about 45 degrees to the lateral axis of the soap bar. In this orientation, the edges will be in a plane through the longitudinal axis to being in a plane about diagonally through the soap bar. The orientation, shape and dimension of this edge will be determined by the secondary package, the number of soap bars to be contained within the secondary package, and the end product rigidity of the secondary package.

The secondary package is comprised of a semi-rigid, to rigid material that when reinforced by the primary package can retain its shape as a package. This primary package can be anchored within the secondary package in various ways. In a preferred technique part of each contained primary package can protrude through a surface of the secondary package. This stabilizes the primary package within the secondary package and the primary package further reinforces the secondary package.

When the secondary package has such apertures the primary package need not have a peripheral edge adapted to reinforce the secondary package. Thus this peripheral edge can be of a reduced dimension so as not to contact the secondary package, or can be of a flexible material that would not substantially reinforce the secondary package.

The primary package and the secondary package can be constructed of various materials. These include paperboard, foils and plastics. Plastics are preferred for the primary package and paperboards for the secondary package. The plastics can be monolayers or laminates.

DETAILED DESCRIPTION OF THE INVENTION

The present invention will be described in the preferred embodiments with reference to the drawings. Other embodiments which utilize the concept of a primary package and a secondary package, and in the instance where the primary package provides support for the secondary package in a similar manner are within the present concept.

Figure 1:
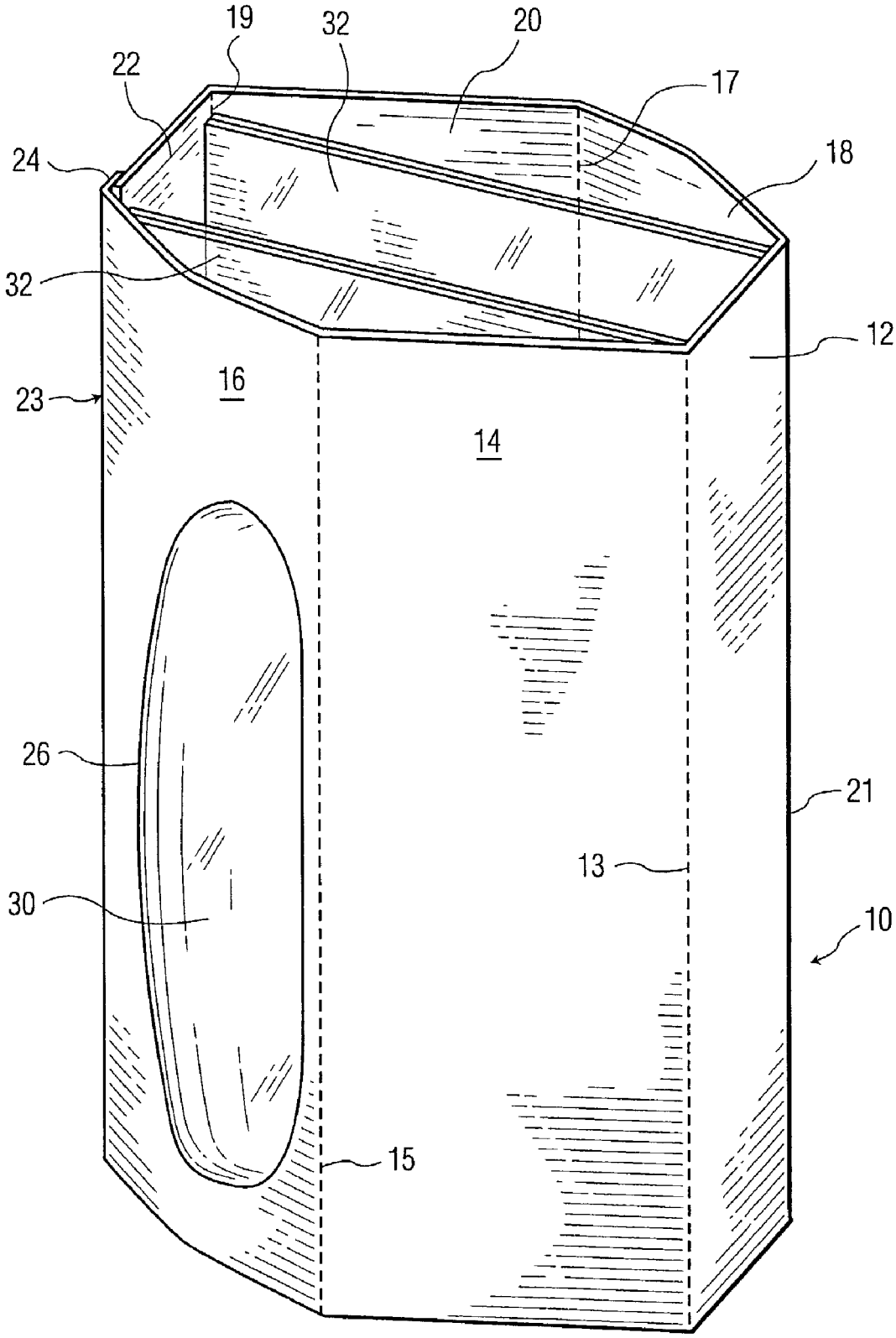
FIG. 1 is a perspective view of two soap bars packaged in a primary package and secondary package.

FIG. 1 shows two packaged soap bars. The soap bars each are in a primary package and the two primary packages are in a secondary package 10. The secondary package has panel surfaces 12, 14, 16, 18, 20 and 22. The panels 16 and 22 are attached at 24 by a glue flap. The panel 16 has an opening 26 through which part of a primary package 30 protrudes. A similar aperture is in panel 18 with part of a soap bar protruding also from this aperture. The protruding primary packages serve to hold the primary packages within the secondary package. Also, seen in FIG. 1 is the edge 32 of each primary package. The fold points of the secondary package are shown by dotted lines at 13, 15, 17 and 19. Fold points also are designated at 21 and 23. Further, the primary packaged soap bars by contact with the inner surface of the secondary package and protruding through apertures in the secondary package supports and provides structure to the secondary package.

Figure 2:
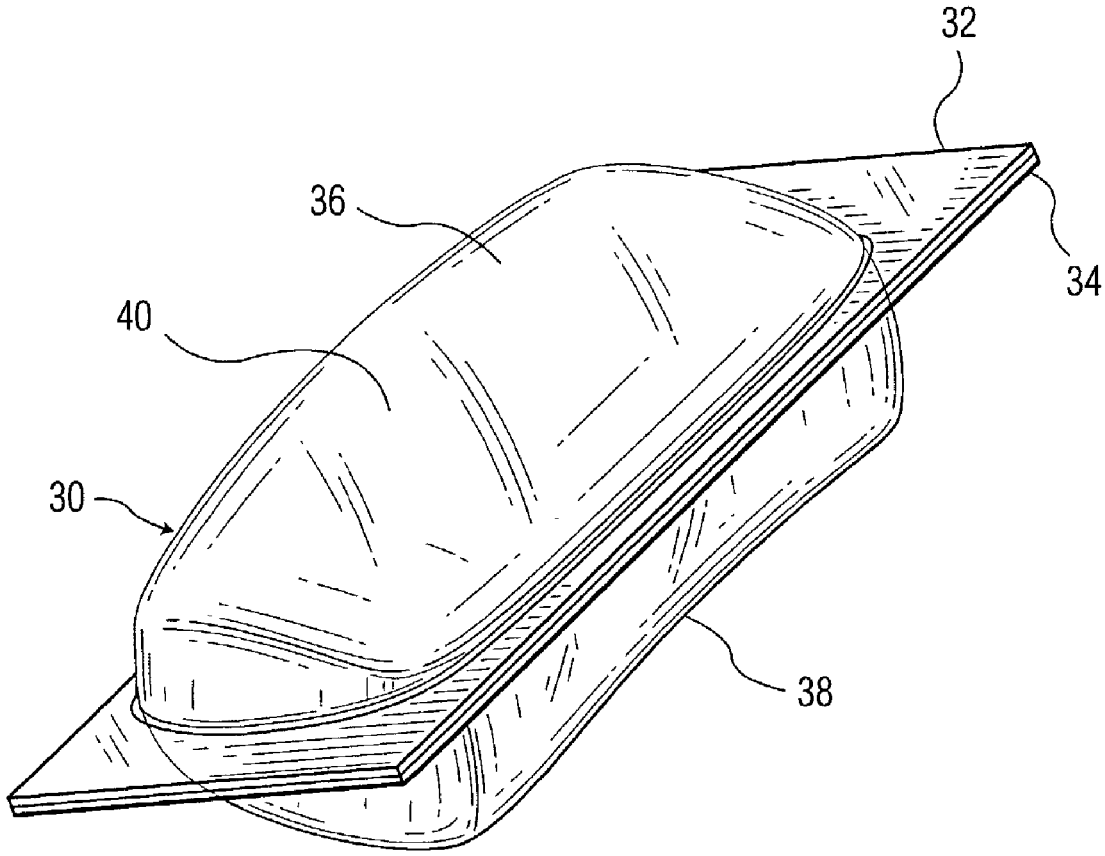
FIG. 2 is a perspective view of a soap bar in a primary package.

FIG. 2 shows a primary package 30 containing a soap bar 40. In this embodiment the primary package is transparent. However, the material of the primary package also can be opaque or translucent. Also, it can be of essentially any color or tint. Here it is comprised of an upper portion 36 with edge 32 and a lower portion 38 with edge 34. The preferred materials for each portion are plastics, and plastics that can be thermoformed. After each portion is formed a soap bar is inserted in one portion and overlayed with the other portion. If then is heat-sealed around the edge to make a sealed primary package.

As an alternative the portions 36 and 38 can be sealed together and then through an injection opening a soap bar composition in a liquid state added to the hollow cavity and the liquid soap bar composition set to a hardened soap bar. In this latter embodiment, the portions 36 and 38 sealed together will have an opening at either end for the injection of the liquid soap composition. This opening is sealed after the injection of the liquid soap composition.

Figure 3:
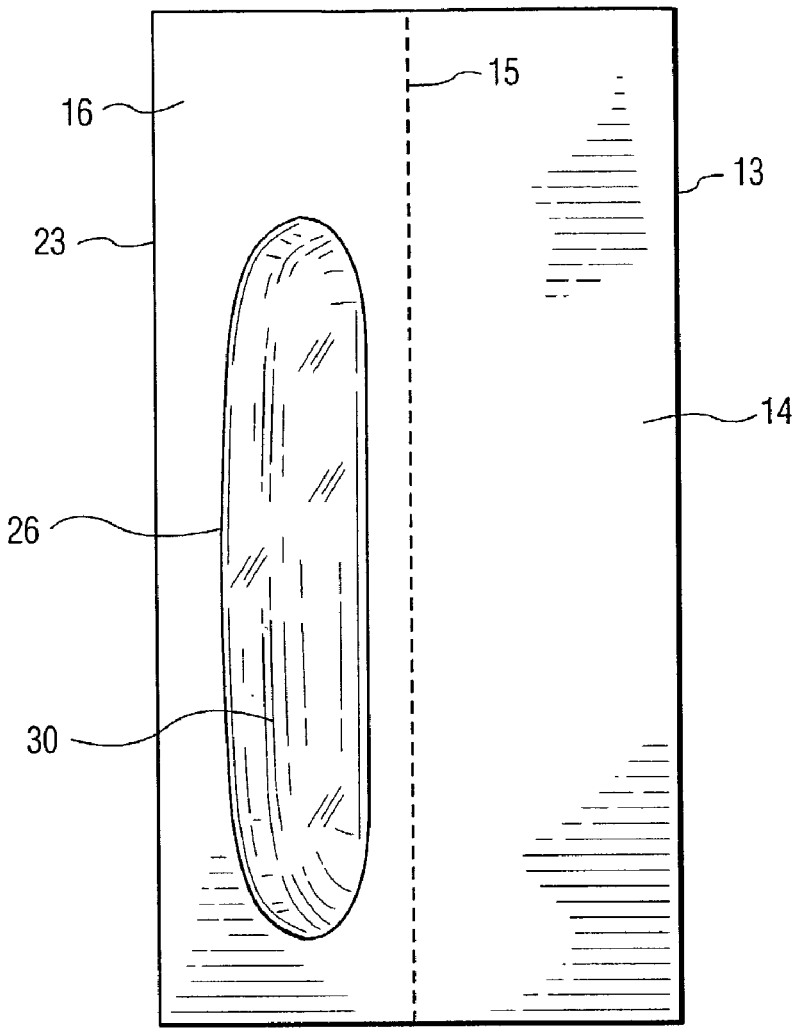
FIG. 3 is an elevational view of the package of FIG. 1.

FIG. 3 shows the packaged soap bar in an elevational view. This view shows many of the features of FIG. 1 but in a different orientation.

The edges 32 and 34 can be an extension of a plane through the longitudinal axis of the soap bar and package. This plane also can be through the lateral axis of the soap bar or at an angle of up to 90 degrees to the lateral axis, and preferably up to about 45 degrees to the lateral axis. The positioning of the edges would be to optimize the reinforcing of the secondary package.

Figure 4:
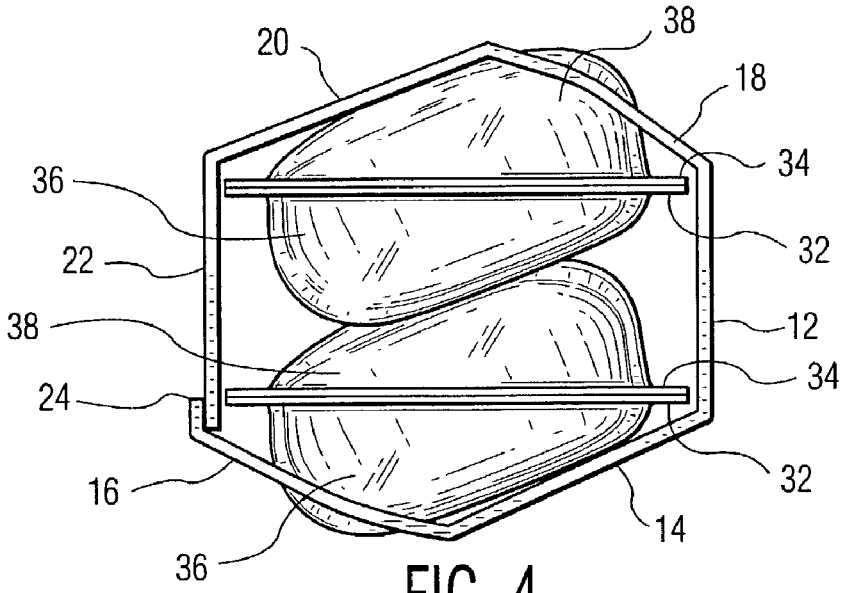
FIG. 4 is a top plan view of the packages of FIG. 1.

FIG. 4 is a top plan view of the two soap bars of FIG. 1 in both the primary and secondary packages. Each primary package has the same structure of portion 36 with edge 32 and portion 38 with edge portion 34. Edges 32, 34 of each primary package support panels 12 and 22 of the secondary package. The primary packages are in a common contact along one side and protrude through panels 16 and 18 on the other side. All parts of the primary packages can be used to reinforce and support the secondary package. This includes all primary package surfaces including the edges 32, 34. The edges 32, 34 as shown serve to form panels 12 and 22 into substantially parallel surfaces. The result is that the secondary package can stand vertically on end as shown in FIG. 1 or horizontally on panels 12, 22, 14 or 20. Also the soap bar products can be readily cartoned for shipment in either orientation.

An optional embodiment is where the primary package does not have a peripheral edge or has a flexible peripheral edge. In this instance the contact of the two soap bars with each other and with the interior wall of the secondary package, and the projecting through the walls of the secondary package will stabilize the primary packaged soap bars in the secondary package. A key feature in this embodiment is each primary packaged soap protruding through the walls of the secondary package.

Figure 5:
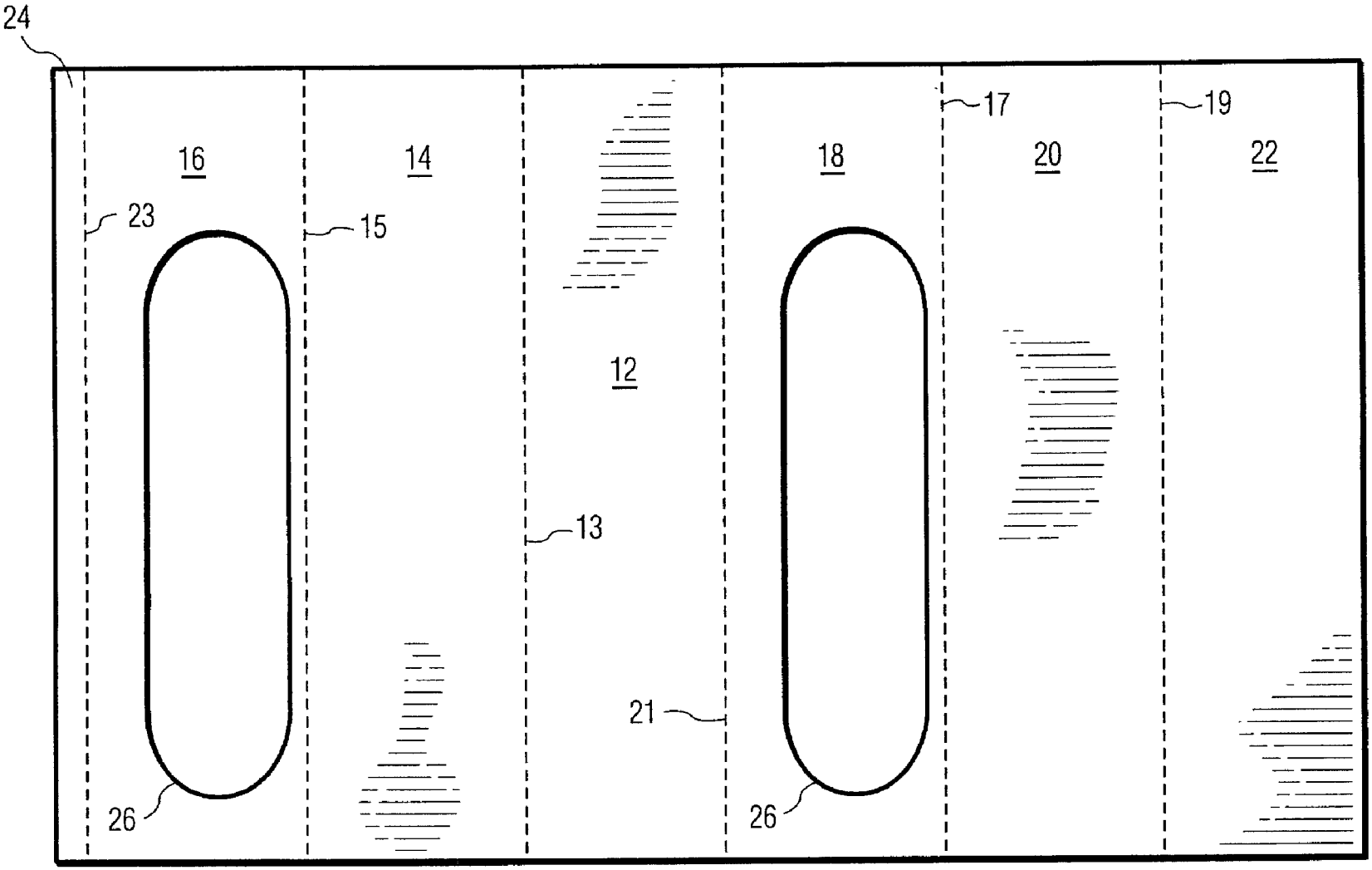
FIG. 5 is a plan view of the blank of the secondary package of FIG. 1.

FIG. 5 shows the blank for the secondary package. There are shown panels 12, 14, 16, 18, 20 and 22. Panels 16 and 18 each have an aperture 26. The glue flap to form the secondary package is at 24. The blank is folded at fold lines 13, 15, 17, 19, 21 and 23. The panels are shown as being about equivalent in width. This is for illustrative purposes. The panels will be sized to accommodate primary packages of a particular size.

The primary and secondary package can be constructed of a variety of materials. These include plastics, foils and paperboards. The secondary package preferably is a paperboard and the primary package, a plastic, and preferably a thermoformable plastic. The plastics can be monolayers or multi-layered laminates. The plastics can be transparent, translucent or opaque. They preferably are thermoplastics such as polyethylenes, polypropylenes or polyesters such as polyethylene terephthalate. They also can be copolymers of ethylene, propylene, butylene vinyl and vinylidene monomers such as vinyl alcohol, vinyl acetate, vinyl chloride, vinylidene chloride and copolymers of these polymers.

The primary package can be of a flexible to a semi-rigid to rigid material. Where it will reinforce the secondary package it will be a semi-rigid to rigid material. The secondary package will be of a semi-rigid material to a rigid material. A semi-rigid material is sufficient and will be a cost savings.

What is claimed is:

1. A packaged soap bar comprising at least one soap bar enclosed in at least one primary package, the at least one primary package contained within a secondary package, said primary package having an enclosing portion fully enveloping said soap bar and an outwardly extending edge portion at a periphery of said enclosing portion, said secondary package having a plurality of connected side panels and, in a completed form of the package, open on at least one end, said outwardly extending edge portion of the primary package extending to adjacent an inner surface of said secondary package to reinforce the panels of said secondary package.

2. A packaged soap bar as in claim 1, wherein a part of said primary package protrudes through an aperture in a panel of said secondary package.

3. A packaged soap bar as in claim 1, wherein there are at least two primary packages in said secondary package, said at least two primary packages being in other than an edge portion contact one to the other, and a part of each primary package protruding through at least one panel of said secondary package.

4. A packaged soap bar as in claim 3, wherein there are two primary packages.

5. A packaged soap bar as in claim 1, wherein said edge portion of said primary package surrounds said primary package.

6. A packaged soap bar as in claim 1, wherein the at least one primary package is comprised of a first portion and a second portion, the soap bar contained between said first portion and said second portion.

7. A packaged soap bar as in claim 6, wherein said first portion and said second portion have a peripheral edge.

8. A packaged soap bar as in claim 1, wherein the at least one primary package is comprised of a plastic.

9. A packaged soap bar as in claim 8, wherein the secondary package is comprised of a paperboard.

10. A packaged soap bar as in claim 8 wherein the secondary package is comprised of a paperboard.

11. A packaged soap bar as in claim 1, wherein said at least one primary package is comprised of a substantially transparent plastic.

12. A packaged soap bar comprising at least one soap bar enclosed in at least one primary package, said at least one primary package contained within a secondary package, said at least one primary package having an enclosing portion surrounding said soap bar, said secondary package having a plurality of side panels and, in a completed form of the package, open on at least one end, at least one of said side panels having at least one aperture, a part of the at least one primary package of said at least one soap bar protruding through said at least one aperture.

13. A packaged soap bar as in claim 12, wherein there are at least two primary packages in said secondary package, said at least one primary packages being in contact one to the other, and a part of each primary package protruding through a panel of said secondary package.

14. A packaged soap bar as in claim 12, wherein there are at least two primary packages in said secondary package, said primary packages being in contact one to the other, and a part of each primary package protruding through a panel of said secondary package.

15. A packaged soap bar as shown in claim 14, wherein there are two primary packages.

16. A packaged soap bars as in claim 12, wherein said edge portion of said at least one primary package surrounds said primary package.

17. A packaged soap bar as in claim 11, wherein the at least one primary package is comprised of a first portion and a second portion, the soap bar contained between said first portion and said second portion.

18. A packaged soap bar as in claim 17, wherein said first portion and said second portion have a peripheral edge.

19. A packaged soap bar as in claim 12, wherein the at least one primary package is comprised of a plastic.

20. A packaged soap bar as in claim 12 wherein said at least one primary package is comprised of a substantially transparent plastic.

* * * * *